United States Patent [19]

May

[11] Patent Number: 4,875,798

[45] Date of Patent: Oct. 24, 1989

[54] RETROREFLECTIVE PAVEMENT MARKER

[75] Inventor: David C. May, St. Paul, Minn.

[73] Assignee: Minnesota Mining and Manufacturing Company, St. Paul, Minn.

[21] Appl. No.: 213,781

[22] Filed: Jun. 30, 1988

[51] Int. Cl.[4] ..... E01F 9/06

[52] U.S. Cl. ..... 404/12; 404/14; 350/102

[58] Field of Search ..... 404/9, 12, 14, 15, 16; 350/97, 102, 103, 109

[56] References Cited

U.S. PATENT DOCUMENTS

| | | | |
|---|---|---|---|
| 3,332,327 | 7/1967 | Heenan | 404/16 |
| 3,392,639 | 7/1968 | Heenan et al. | 404/12 |
| 3,409,344 | 11/1968 | Balint | 350/103 |
| 3,485,148 | 12/1969 | Heenan | 404/12 |
| 3,627,403 | 12/1971 | Hedgewick | 350/103 |
| 3,924,929 | 12/1975 | Holmen | 404/9 |
| 4,070,095 | 1/1978 | Suhr | 350/97 |
| 4,208,090 | 7/1980 | Heenan | 350/61 |
| 4,227,772 | 10/1980 | Heenan | 350/103 |
| 4,232,979 | 11/1980 | Johnson, Jr. et al. | 404/16 |
| 4,349,598 | 9/1982 | White | 428/161 |
| 4,428,320 | 1/1984 | Oplt | 404/14 |
| 4,498,733 | 2/1985 | Flanagan | 404/14 |
| 4,588,258 | 5/1986 | Hoopman | 350/103 |

*Primary Examiner*—Jerome W. Massie, IV
*Assistant Examiner*—Gay A. Spahn
*Attorney, Agent, or Firm*—Donald M. Sell; Walter N. Kirn; Douglas B. Little

[57] ABSTRACT

A raised retroreflective pavement marker that provides both improved retroreflectivity and longer life has a rigid opaque, synthetic resin body having at its front face septa to which a plastic cube-corner reflector has been bonded to provide a plurality of hermetically sealed cells beneath the reflector. This pavement marker differs from those on the market in that the thickness of its reflector is less than 2 mm, and it has preferably at least 500 cube-corner elements per $cm^2$.

11 Claims, 2 Drawing Sheets

RETROREFLECTIVE PAVEMENT MARKER

BACKGROUND OF THE INVENTION

1. Field of the Invention

The invention concerns raised pavement markers that are retroreflective and are primarily used to delineate traffic lanes on roadways.

2. Description of the Related Art

Raised retroreflective pavement markers, as compared to stripes of retroreflective tape or paint, provide better long-range visibility at night, especially when wet, and when the tire of a vehicle strikes a raised pavement marker, the driver is alerted by the noise and vibration. Unfortunately, repeated tire impacts can damage and eventually break either the retroreflective material or the body of the pavement marker or tear the marker from the pavement.

Amerace Corp. markets as "Stimsonite 88" a raised pavement marker like that illustrated in U.S. Pat. No. 3,332,327 (Heenan). Its shell is a light-transmitting thermoplastic resin in the form of a truncated pyramid and has been injection molded to form on the inner face of one of its sloped sides a cube-corner pattern to provide an array of retroreflective elements. After coating that inner face with a light-reflecting material, e.g., aluminum, the plastic shell is "potted"with a relatively rigid filler material such as a filled epoxy resin, and the bottom surface of the cured epoxy resin is adhesively bonded to the pavement.

As is pointed out in the Heenan patent, the outer face of the cube-corner reflector (which the patent calls "the obverse face") is sloped from the roadway at an angle large enough for good reflectivity and small enough to allow adequate wiping by vehicle tires, i.e., from 15° to 45° and preferably 30° to the surface of the roadway. The Heenan patent suggests "methyl methacrylate" for the shell of light-transmitting resin. Because polymethylmethacrylate resin is brittle, it has poor impact and breaks if flexed to a significant extent. For better impact resistance, the shell could be polycarbonate resin, but it has less resistance to abrasion than does methylmethacrylate resin.

While the "Stimsonite 88" pavement marker affords good visibility at night, it has poor daytime visibility, because substantially the only material visible to the approaching driver is the cube-corner reflector. Other raised pavement markers attain better daytime visibility by exposing a larger area of nonreflective surfaces to oncoming traffic. For example, see U.S. Pat. Nos. 3,392,639 (Heenan et al.); 4,208,090 (Heenan) 4,498,733 (Flanagan); 4,227,772 (Heenan); and 4,232,979 (Johnson et al.).

The bottom surface of a pavement marker of Heenan 4,227,772 is honeycombed by rectangular molding recesses that form vertical partitions or walls and serve to prevent sinks or shrink stresses during molding.

At the bottom surface of the Johnson pavement marker is an impact-absorbing material or pad which may be an elastomeric adhesive material such as butyl rubber by which the marker is bonded to the roadway (col. 7, lines 14–24). The flexing that would be permitted by such a pad is contrary to instructions accompanying most raised pavement markers which suggest that the adhesive should be rigid, because a flexible adhesive would allow the body of the pavement marker to flex under tire impact. Even a rigid adhesive cannot prevent the pavement from flexing, and when the pavement flexes, the body of the pavement marker necessarily flexes to the same extent. Repeated flexing due to impacts eventually can produce cracks in either or both the shell and filled body of a pavement marker and can also cause delamination between the shell and the filled body. Furthermore, flexing at the adhesive tends to fatigue the adhesive, thus permitting the pavement marker to loosen from the roadway. To minimize this, each raised pavement marker is sometimes mounted on a metal plate that has been fixed to a recess in the pavement, but to do so can be exceedingly expensive. Without using such a metal plate, pavement markers currently on the market can be expected to fail within two or three years and, in a typical installation, it can be necessary to replace about one-third of the markers every year.

Amerace Corp. markets as "Stimsonite 66" a raised pavement marker that is similar to that illustrated in the above-cited Flanagan patent. The "Stimsonite 66" pavement marker has an opaque synthetic resin body, at one surface of which is a plastic reflector that is retroreflective by virtue of a cube-corner pattern formed in its inner face. Also projecting from the inner face of the plastic reflector are septa (which the Flanagan patent calls "peripheral walls") that provide supports to prevent the apices of the cube-corner elements from contacting the opaque resin body of the pavement marker when impacted by a tire. The septa create a plurality of hermetically sealed cells beneath the reflector. The Flanagan patent explains: "In the event of damage to one or more of the reflector elements, only that particular air cell containing the reflective element loses its hermetic seal and thereby ultimately becomes optically ineffective" (col. 8, lines 25–29). Flanagan also says that the peripheral walls may be integrally formed as part of the support surface, or of the reflector, or as a separate piece.

The reflector of the "Stimsonite 66" pavement marker extends at an angle of 45° to the roadway. As compared to the 30° angle preferred by Heenan U.S. Pat. No. 3,332,327, this steeper angle reduces tire impact and also provides better retroreflective brightness. In the "Stimsonite 66" pavement marker, the overall thickness of the reflector is about 0.125 inch (3.2 mm) and there are 16 individual cube-corner elments per $cm^2$.

U.S. Pat. No. 4,726,706 (Attar) also shows a raised pavement marker having a plastic cube-corner reflector that is formed with septa or load carrying walls. Because of these septa, the reflector of the Flanagan and Attar patents are not coated with aluminum or other light-reflecting material and thus avoid the loss of retroreflectivity that such a coating would entail. For further disclosure of the value of septa, see also U.S. Pat. No. 3,924,929 (Holmen).

Each of the plastic cube-corner reflectors of the above-discussed pavement markers is an individually molded piece and inevitably far from perfect optically when produced by molding at commerically useful production rates. The reflector of the raised pavement marker of U.S. Pat. No. 4,428,320 (Oplt et al.) can be cut from reflectorized sheeting. All that Oplt says about the sheeting is that it preferably is "a polycarbonate reflective tape, of the type manufactured by the Reflexite Corporation" under the trademark "Reflexite" (col. 2, lines 57–61). The "Reflexite" tape is understood to be made by forming a cube-corner replica by stamping, casting or extruding a thermoplastic resin onto the grooved surface of a master plate. The Oplt patent says that the tape is reflectorized, thus permitting it to be mounted flush against the body of the marker as illustrated. Although the Oplt patent does not say so, the "Reflexite" tape is poorly reflective except to light impinging substantially orthogonally, and it may be partly for this reason that the reflective tape of the illustrated marker extends almost vertical to the roadway. This also reduces tire impact.

A cube-corner reflector or sheeting that, unlike the "Reflexite" tape, does have good retroreflectivity along multiple viewing planes, is disclosed in U.S. Pat. No. 4,588,258 (Hoopman) and so would afford good retroreflectivity to oncoming traffic when mounted at a shallow angle to the roadway as in Heenan U.S. Pat. No. 3,332,327.

As compared to the reflector of the "Stimsonite 66" pavement marker, the cube-corners of the reflectors of the Hoopman patent are quite small, thus allowing the sheeting to be much thinner. In Example 3 of the Hoopman patent, the reflector was formed from 0.030-inch (0.75-mm) acrylic film, and it has about 1075 cube-corner elements per $cm^2$.

SUMMARY OF THE INVENTION

The invention provides a raised retroreflective pavement marker that should have both better retroreflectivity and longer life than do raised pavement markers now on the market. Like that of the Flanagan patent, the novel pavement marker can have a substantially rigid, opaque, synthetic resin body that has been injection molded to have at its front face or faces septa to which a plastic cube-corner reflector can be bonded to provide a plurality of hermetically sealed cells beneath the reflector, the depth of which is sufficient to ensure that the cube corners of the reflector between the septa do not contact the body when the pavement marker is adhered to a roadway and subjected to vehicular impact. Also like that of the Flanagan patent, the novel pavement marker preferably does not have a coating of aluminum or other light-reflecting material. The novel pavement marker differs from that of the Flanagan patent in that:

- the septa necessarily project from the body of the marker, not from the plastic reflector,
- the exposed surface of the plastic reflector forms an angle of from 1520 to 45° to the surface of the roadway (as it does in Heenan U.S. Pat. No. 3,332,327), the overall thickness of the reflector is less than 2 mm, and
- preferred embodiments of the reflector have many more cube-corner elements per $cm^2$ than are disclosed in Flanagan.

In spite of its plastic reflector being so thin, the novel pavement marker is remarkably durable. It is surprising that such a thin reflector provides a raised pavement marker having significantly longer useful life as compared to the "Stimsonite 66" pavement markers, in spite of the latter's much thicker reflector. In tests reported below, prototypes of the novel marker have demonstrated remarkably good resistance to heavy vehicular traffic.

The retroreflectivity of the thin cube-corner reflector of Example 1 below is so great that a novel pavement marker bearing that reflector would satisfy typical highway specifications even if its septa (including those extending along the perimeter of the reflector) were to be enlarged to cover 70% of the area of the reflector. To provide good durability, the septa should cover at least 10% of the reflector area, preferably about 25%.

Plastic cube-corner reflectors for the novel pavement marker can be made as disclosed in Example 2 of the Hoopman patent. Because that reflector and the reflector of Example 1 below can be quite thin, they can be produced at high production rates while faithfully replicating the master mold. The reflectors can be as thin as about 0.5 mm in overall thickness, but for better durability their overall thickness preferably is from 1.0 to 1.5 mm. By overall thickness of the reflector is meant the distance between its exposed face and the apices of its cube-corner elements.

A master mold for making plastic cube-corner reflectors for use in the novel pavement marker can be made by cutting intersecting sets of parallel grooves in a flat metal surface with a V-shaped diamond tool as disclosed in U.S. Pat. No. 3,712,706; see for example column 3, lines 35–54; column 4, line 57 through column 5, line 24; and column 17, line 25 through column 22, line 47, all of which are incorporated herein by reference. Duplicate dies of the master mold can be made from the negative molds by electroforming or other well-known techniques for mold duplication. A transparent plastic film or sheet may then be pressed against the duplicate die to form or emboss in the film or sheet the pattern of the master mold. Alternatively, a liquid film-forming material could be cast onto the mold. By controlling the depth of the impression on the plastic film or sheet, the base portion of the film or sheet which does not receive the mold impression then serves as a transparent cover sheet for the resulting retroreflective material.

To permit plastic cube-corner reflectors of the invention to be made at high production rates while being highly retroreflective over a reasonably wide range of angles, the individual cube-corner elements should be small, i.e., there should be at least 500 cube-corner elements per $cm^2$, more preferably at least 1000.

Preferably, the plastic cube-corner reflector of the novel pavement marker is a thermoplastic resin having an impact resistance (ASTM D3029) of at least 30 ft-lbs./in. (16 J/cm), and a flexural modulus (ASTM D790) of at least 200,000 psi (1400 MPa). Such values are provided by polycarbonates and impact-modified acrylic resins.

Like the pavement marker of Heenan U.S. Pat. No. 4,227,772, the bottom surface of a novel pavement marker preferably has honeycomb recesses that open through its bottom surface. The honeycomb of test prototypes of the novel marker differs from that of the pavement marker of Heenan U.S. Pat. No. 4,227,772 by having a plurality of vertical partitions which extend the full width of the pavement marker and are interconnected to form honeycomb cells that individually extend less than half the width of the marker and are staggered in the direction of vehicular travel, thus reducing the tendency of cracks to propogate.

BRIEF DESCRIPTION OF THE DRAWINGS

The invention may be more easily understood in reference to the drawing, all figures of which are schematic. In the drawing.

DETAILED DESCRIPTION OF THE PRESENT INVENTION

Figure 1:
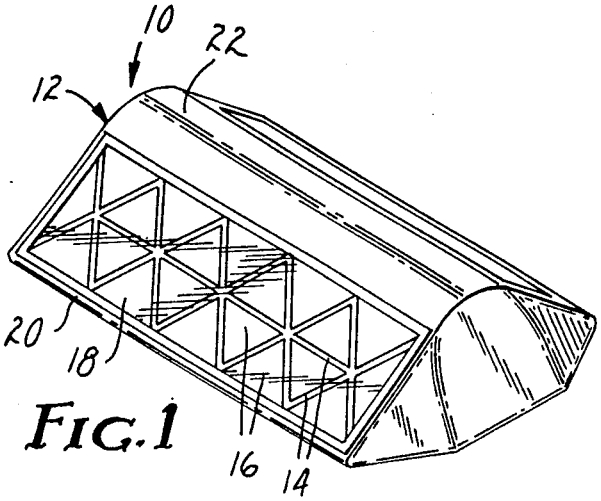
FIG. 1 is a perspective view of the body of a preferred raised pavement marker of the invention.
Figure 2:
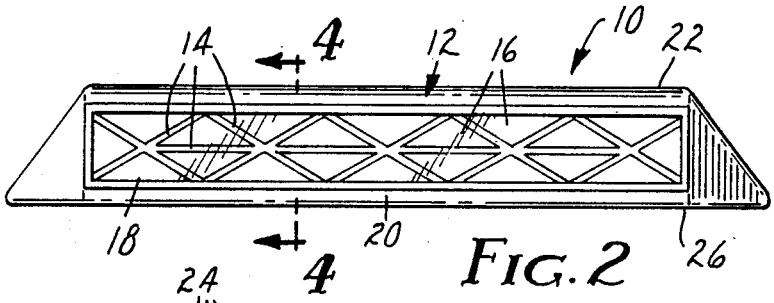
FIG. 2 is an elevation looking at the front face the pavement of marker body FIG. 1.
Figure 3:
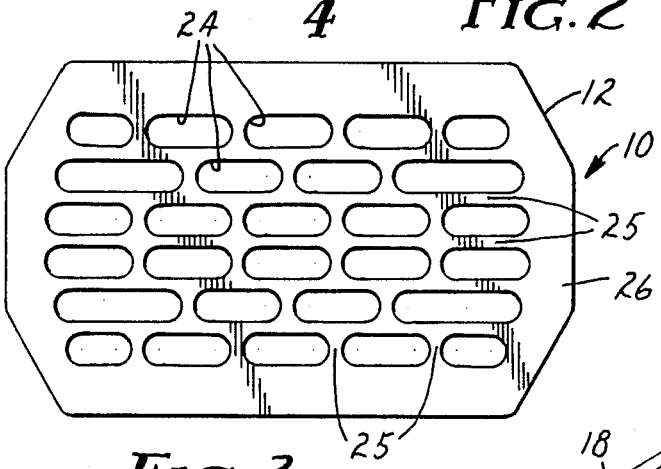
FIG. 3 shows the bottom surface of the pavement marker body of FIG. 1.
Figure 4:
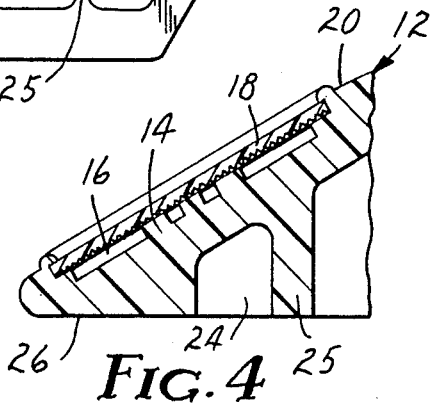
FIG. 4 is a fragmentary section along line 4—4 of FIG. 2 with a thin cube-corner reflector in place.

The raised pavement marker 10 of FIGS. 1-4 has a rigid synthetic resin body 12, at the front of which septa 14 project to form a plurality of cells 16. In FIG. 4, a retroreflective cube-corner reflector 18 has been ultrasonically bonded to the septa, thus hermetically sealing the cells 16. The resin body has sloped sides 20 and a rounded top surface 22 that can be colored to afford good daytime visibility.

The resin body 12 is formed with a plurality of vertical partitions 24 that extend the full width of the body and are interconnected by webs 25 to form honeycomb recesses that open through the bottom surface 26 of the body as seen in FIG. 3. By being staggered the webs 25 tend to divert crack-propagating forces to which the pavement marker 10 may be subjected in the direction of traffic movement.

Figure 5:
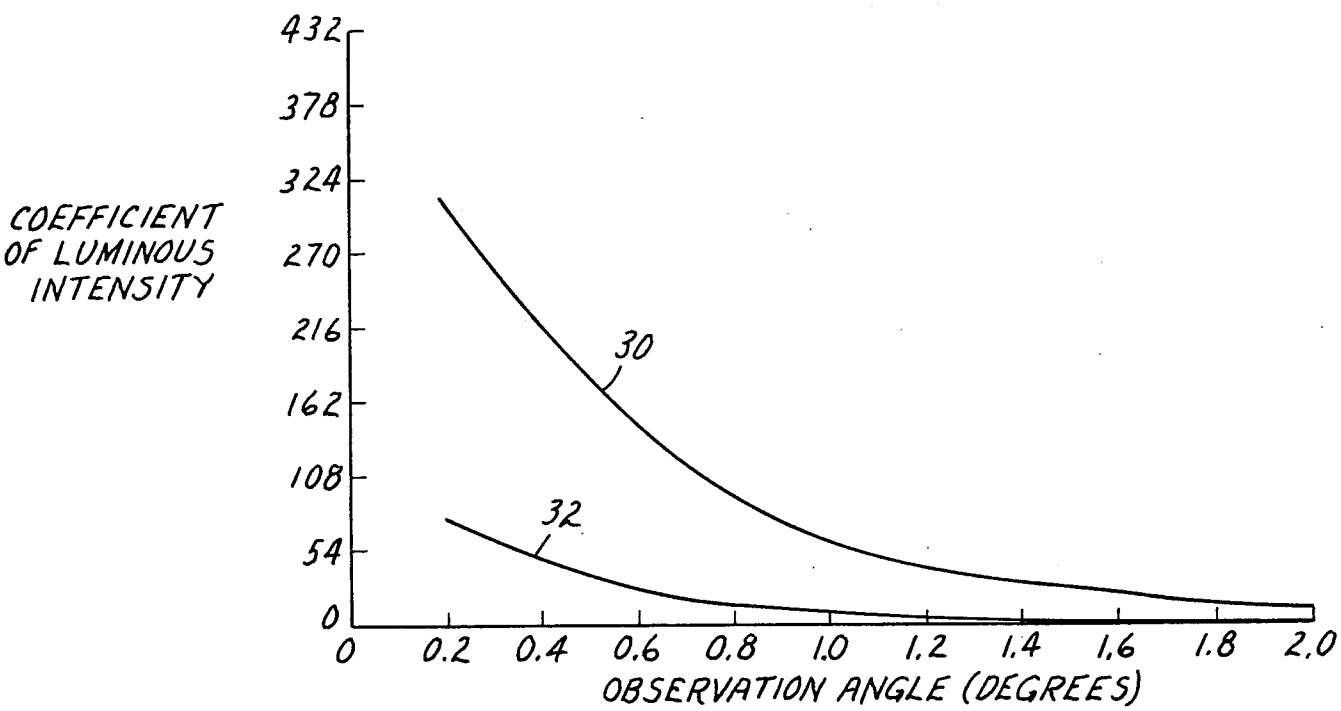
FIG. 5 graphically illustrates the retroreflectivity of a prototype pavement marker of the invention in comparison to the "Stimsonite 88" pavement marker.

FIG. 5 shows for two pavement markers the coefficient of luminous intensity in candelas/lux vs. observation angle (in degrees) for light projected in the direction of traffic flow. Observation angle is the angle between a line from the illumination source to a point on the reflector and a line from the light receptor to the same point on the reflector. Curve 30 shows retroreflective values for the pavement markers of Example 1 of the invention as disclosed below. Curve 32 shows retroreflective values for the "Stimsonite 88" pavement marker described above. A comparison of curves 30 and 32 shows that the retroreflectivity of the pavement marker of Example 1 is at least four times that of the "Stimsonite 88" marker.

The "Stimsonite 66" marker described above (which has a reflector supported by septa) has retroreflective values substantially lower than those of curve 32, in spite of the fact that its reflector extends at an angle of 45° to the roadway.

EXAMPLE 1

A master mold was made by cutting a first set of parallel grooves with an included angle of approximately 90°. Each groove was angularly symmetric (45° of the groove on each side of the perpendicular). A second set of grooves were cut to intersect the first set at 90°, with one vertical sidewall and one sidewall at 30° to the vertical. The spacings between the bottoms of the grooves were 0.36 mm and 0.23 mm for the first and second sets of grooves, respectively.

The master mold was replicated to form a stamper, and a sheet of polycarbonate resin ("Lexan" 121R available from General Electric; 0.040 inch (1.0 mm) in thickness) was placed between the stamper and a polished steel plate. These were placed in a platten press at 190° C. for 10 seconds, and the pressure was increased to 2200 lbs/in$^2$ (15 MPa) and held for 20 seconds. After cooling under pressure to less than 70° C., the resulting retroreflective cube-corner reflector was stripped from the stamper. The cube-corner reflector was 22 cm square. It had 1204 cube-corner elements per cm$^2$ and an overall thickness of 1.5 mm.

A pavement marker body as illustrated in the drawing was injection molded from the same polycarbonate resin as had been used for the cube-corner reflector except being highly pigmented to have a bright yellow color. Each of its septa had a width of about 1.0 mm and a height of about 1.25 mm. The cube-corner reflector was ultrasonically bonded along the entire length of every septum including the entire perimeter of the septa so that each cell between the septa was individually hermetically sealed.

Comparative Testing 124 pavement markers of Example 1 were adhesively bonded to pavement in areas carrying heavy traffic including large trucks. About halt of the pavement markers were adhered to concrete and halt to asphalt. About half of the markers were adhered to each type of pavement using a bituminous hot-melt adhesive, and the other half using a room-temperature-curing epoxy adhesive. Both adhesives are widely used for adhering raised pavement markers to pavement. After 69 days, every pavement marker was undamaged except three, the reflectors of which were partially broken, but all three still had sufficient retroreflectivity to meet typical highway specifications.

363 "Stimsonite 66" pavement markers were adhered to concrete or asphalt pavement in areas carrying traffic comparable to that to which the prototypes of Example 1 had been subjected. After 64 days, 138 (38%) of the "Stimsonite 66" pavement markers had suffered some reflector breakage.

We claim:

1. Raised pavement marker comprising a substantially rigid body having a bottom surface, at least one sloped face, septa projecting from said sloped face, and a plastic cube-corner reflector, having at least 500 cube-corner elements per cm$^2$ formed by intersecting sets of parallel grooves, bonded to the septa to provide a plurality of cells beneath the reflector, the depth of which is sufficient that cube corners of the reflector between the septa do not contact the body when the pavement marker is adhered to a roadway and subjected to vehicular impact, said pavement marker being characterized by:

the exposed face of the reflector forming an angle of from 15° to 45° to the surface of the roadway and the overall thickness of the cube corner reflector being less than 2 mm.

2. Raised pavement marker as defined in claim 1, wherein each cell contains a plurality of cube-corner elements.

3. Raised pavement marker as defined in claim 2, the reflector of which has at least 1000 cube-corner elements per cm$^2$.

4. Raised pavement marker as defined in claim 1 wherein the overall thickness of the reflector is at least 0.5 mm.

5. Raised pavement marker as defined in claim 4 wherein the overall thickness of the reflector is from 1.0 to 1.5 mm.

6. Raised pavement marker as defined in claim 1 wherein the reflector is a thermoplastic resin having an impact resistance of at least 16 J/cm and a flexural modulus of at least 1400 MPa.

7. Raised pavement marker as defined in claim 1 wherein the septa contact from 10 to 70% of the area of the reflector.

8. Raised pavement marker as defined in claim 7 wherein the septa between the cells have substantially uniform width of about 1 mm.

9. Raised pavement marker as defined in claim 7 wherein the septa have a uniform height of about 1.25 mm.

10. Raised pavement marker as defined in claim 1, the body of which comprises a plurality of vertical partitions that extend the full width of the pavement marker and are interconnected by webs to form honeycomb recesses that open through its bottom surface.

11. Raised pavement marker as defined in claim 10 wherein said webs are staggered in the direction of vehicular travel.

* * * * *

UNITED STATES PATENT AND TRADEMARK OFFICE

CERTIFICATE OF CORRECTION

PATENT NO. : 4,875,798

DATED : October 24, 1989

INVENTOR(S) : David C. May and Thomas D. Krech

It is certified that error appears in the above-identified patent and that said Letters Patent is hereby corrected as shown below:

On the title page:

Item [19] "May" should read -- May et al--.

Item [75] Inventor: David C. May should read --David C. May and Thomas D. Krech--.

Signed and Sealed this

Nineteenth Day of January, 1993

*Attest:*

DOUGLAS B. COMER

*Attesting Officer*

*Acting Commissioner of Patents and Trademarks*